US006076715A

United States Patent [19]

Easter

[11] Patent Number: 6,076,715

[45] Date of Patent: Jun. 20, 2000

[54] FIREARM RETAINING APPARATUS

[76] Inventor: Michael D. Easter, 840 J St., Penrose, Colo. 81240

[21] Appl. No.: 09/074,612

[22] Filed: May 8, 1998

[51] Int. Cl.[7] ..... F41C 33/00

[52] U.S. Cl. ..... 224/149; 224/239; 224/913; 224/931; 224/672; 224/671; 224/270; 224/231

[58] Field of Search ..... 224/149, 913, 224/239, 931, 223, 671, 672, 270, 231

[56] References Cited

U.S. PATENT DOCUMENTS

| | | | |
|---|---|---|---|
| 1,201,159 | 10/1916 | Dettmer | 224/231 |
| 1,392,551 | 10/1921 | Batchelder | 224/931 |
| 3,501,074 | 3/1970 | Emerick | 224/913 |
| 5,029,741 | 7/1991 | Easter | 224/149 |

*Primary Examiner*—Linda J. Sholl
*Attorney, Agent, or Firm*—Phillip A. Rein

[57] ABSTRACT

A firearm retaining apparatus operable to be carried on a user's belt member and positioned at a forward mid portion of the firearm user and having means thereon for retaining and supporting portions of a hunting rifle in vertical or horizontal positions. The firearm retaining apparatus includes 1) a main firearm retainer member of a U-shape and rigid construction; 2) a retainer and flap cover assembly of a flexible construction wrapped vertically about the main firearm retainer member; and 3) a front pocket and cartridge retainer assembly operable to be interconnected to itself and extended horizontally about the main firearm retainer member. The retainer and flap cover assembly is operable to be extended and covered about an outer surface of the main firearm retainer member and providing a rest for the hunting rifle thereon. The front pocket and cartridge retainer assembly is of a one-piece construction extended horizontally about a front wall section of the main firearm retainer member to provide 1) an outer front pocket section to carry and enclose various items therein; and 2) a cartridge retainer storage section to receive and support rifle cartridges therein through an elastic cartridge retainer member and having an outer cartridge retainer section with a Velcro connector to releasably connect same to the front pocket section.

18 Claims, 8 Drawing Sheets

FIREARM RETAINING APPARATUS

CROSS REFERENCE TO RELATED APPLICATIONS

Not Applicable.

STATEMENT REGARDING FEDERALLY SPONSORED RESEARCH OR DEVELOPMENT

Not Applicable.

PRIOR ART

A patent search was not conducted on this invention. A pertinent reference is U.S. Pat. No. 5,029,741 entitled "Firearm Holding Apparatus", inventor Michael D. Easter, the applicant herein.

A copy of all references cited against subject U.S. Pat. No. 5,029,741 was obtained and only the following are deemed pertinent:

| U.S. Pat. No. | Invention | Inventor |
|---|---|---|
| 4,787,540 | HAND GUN HOLSTER SELECTIVELY CONFIGURED AND TO BE PLACED ON A BELT | John C. Barry |
| 4,911,345 | GUN CADDY | James et al |

The Easter patent '741 discloses a firearm holding apparatus operable to receive and support a rifle 99 thereon in FIGS. 4, 5, and 6 on a flexible medial support member 38.

The Barry patent discloses a hand gun holster supported on a belt.

The James et al patent discloses a gun caddy integral with a belt and having a U-shaped pocket 5 to receive and support a butt end of a gun or rifle therein.

BRIEF SUMMARY OF THE INVENTION

In one preferred embodiment of this invention, a firearm retaining apparatus is provided operable to hold and retain a hunting rifle or shotgun in a vertical or horizontal position directly on top of the user's belt primarily for use in a method of hunting or target shooting operation. The firearm retaining apparatus is operable to be attached and supported on a person's belt member and extended forwardly and centrally of the person utilizing same.

The firearm retaining apparatus is operable to receive and convey rifle cartridges or shotgun shells therein and having an enclosed front pocket member for receiving and holding other items at the user's option.

The firearm retaining apparatus includes 1) a main firearm retainer member; 2) a retainer and flap cover assembly; and 3) a front pocket and cartridge retainer assembly.

The main firearm retainer member is of a U-shape and constructed of plastic, aluminum, or steel plate material having a rear wall section integral with an arcuate intermediate wall section which, in turn, is integral with a front wall section. The rear and front wall sections are parallel to each other and interconnected by the intermediate wall section.

The front wall section extends outwardly a greater distance from the rear wall section to assist in retaining the hunting rifle or shotgun as will be described in detail.

The retainer and flap cover assembly is of a one-piece construction and preferably of a leather material having 1) a front wall retainer cover section; 2) a rear wall retainer cover section; 3) a belt contacting section; and 4) a front pocket cover section. All of these cover and support sections are integral with each other to achieve the one-piece construction.

The front wall retainer cover section includes an outer folded end portion enclosing an outer portion of the front wall section of the main firearm retainer member and anchored thereabout as will be explained. The rear wall retainer cover section covers the intermediate wall section and the rear wall section of the main firearm retainer member.

The belt contacting section or gun retaining section includes a horizontal portion integral with a vertical anchor portion. The vertical anchor portion is secured at outer edges by anchor sewed portions to adjacent outer folded end portions of the front wall retainer cover section.

The front pocket cover section includes an outer curved edge and a VELCRO connector. The VELCRO connector is operable to have a hoop section cooperating with a loop section to provide a well-known readily releasable interconnection therebetween. The term "VELCRO" is a federally registered trademark not owned by the applicant herein and hereafter referred to as "a hook and loop connector".

The front pocket and cartridge retainer assembly is of a one-piece construction utilizing a leather or canvas material. The front pocket and cartridge retainer assembly includes 1) a front retainer cover section; 2) a front pocket section; 3) a cartridge retainer storage section; and 4) an outer cartridge retainer section.

The outer cartridge retainer section is integral with the cartridge retainer storage section which, in turn, is integral with the retainer cover section and is then integral with the front pocket section.

The front retainer cover section includes an anchor portion and a front wall portion. The anchor portion is anchored by a stitch portion to a part of the front pocket section as will be explained.

The front pocket section has a 1) end wall portions; 2) a bottom wall portion; 3) stitch portions; and 4) a hook and loop connector thereon. The end wall portions are connected to adjacent areas of the front wall retainer cover section by a respective stitch portion. An outer area of the bottom wall portion is folded upwardly and secured by a stitch portion to an adjacent abutting area of the front wall retainer cover section.

The cartridge retainer storage section includes a first loop portion connected by a stitch portion to the anchor portion of the front retainer cover section and a cartridge retainer member. The cartridge retainer member is preferably constructed of elastic material and having a retainer stitch portion between various portions thereof as noted in FIG. 8 to form loops operable to retain a respective rifle cartridge therein in a manner to be explained.

The outer cartridge retainer section includes a Velcro connector thereon engageable with the hook and loop connector on the front pocket section.

The firearm retaining apparatus is operable to be mounted about a user's belt member which is mounted within an area between the inner surface of the rear wall section of the main firearm retainer member and the cartridge retainer storage section.

The belt contacting section of the retainer and flap cover assembly is operable to receive a stock portion or a mid portion of the hunting rifle or shotgun thereon for support by the belt member as noted in FIGS. 1, 2, and 6.

The outer cartridge retainer section can be released from its' Velcro connection to the front pocket section and pulled outwardly to reveal the rifle cartridges as noted in FIG. 3. A cartridge shell can be readily removed therefrom for subsequent usage in a hunting rifle.

Next, the outer cartridge retainer section can then be moved to a closed condition and interconnected by the hook and loop connectors as noted in FIGS. 1 and 5.

Further, it is noted that the outer front wall cover section can be released from its hook and loop connectors and moved to an opened condition for adding or retrieving items from the front pocket section.

The firearm retaining apparatus having the retainer and flap cover assembly of a rubber or leather material provides a slip resistant surface thereon which acts as a retainer or restriction to lateral movement of the outer end section and the mid support section of the hunting rifle or shotgun.

OBJECTS OF THE INVENTION

One object of this invention is to provide a firearm retaining apparatus which can be readily conveyed on a user's belt member and 1) having means thereon to receive and store rifle cartridges or shotgun shells therein; 2) having a front pocket section operable to receive and store items therein and having a front pocket cover section thereon to contain items in the front pocket section; and 3) having a belt contacting section constructed of a flexible material to receive, support, and position portions of a rifle or shotgun member directly over a user's belt member.

Another object of this invention is to provide a firearm retaining apparatus constructed of 1) a rigid main firearm retainer member; 2) a retainer and flap cover assembly operable to provide an outer cover portion about the main firearm retainer member; and 3) a front pocket and cartridge retainer assembly having a cartridge retainer storage section operable to be pulled outwardly to reveal a cartridge retainer member operable to receive and support cartridge members therein and being moved to a retracted position to conceal and support the cartridge members.

One other object of this invention is to provide a firearm retaining apparatus having a main retainer and flap cover assembly of a flexible material operable to receive a hunting rifle or shotgun thereon, a front pocket and cartridge retainer assembly operable to form a front pocket section and a cartridge retainer storage section, and an outer cartridge retainer section releasably closed by Velcro connectors to enclose the front pocket section.

Still, one other object of this invention is to provide a firearm retaining apparatus that is economical to manufacture; simple in usage thereof; constructed of a leather or other slip resistant and flexible material to provide a movement restricting function; providing a new and novel method of holding and restraining a hunting rifle or shotgun thereon; mountable on a user's belt member; and substantially maintenance free.

Various other objects, advantages, and features of the invention will become apparent to those skilled in the art from the following discussion, taken in conjunction with the accompanying drawings, in which:

Figure 1:
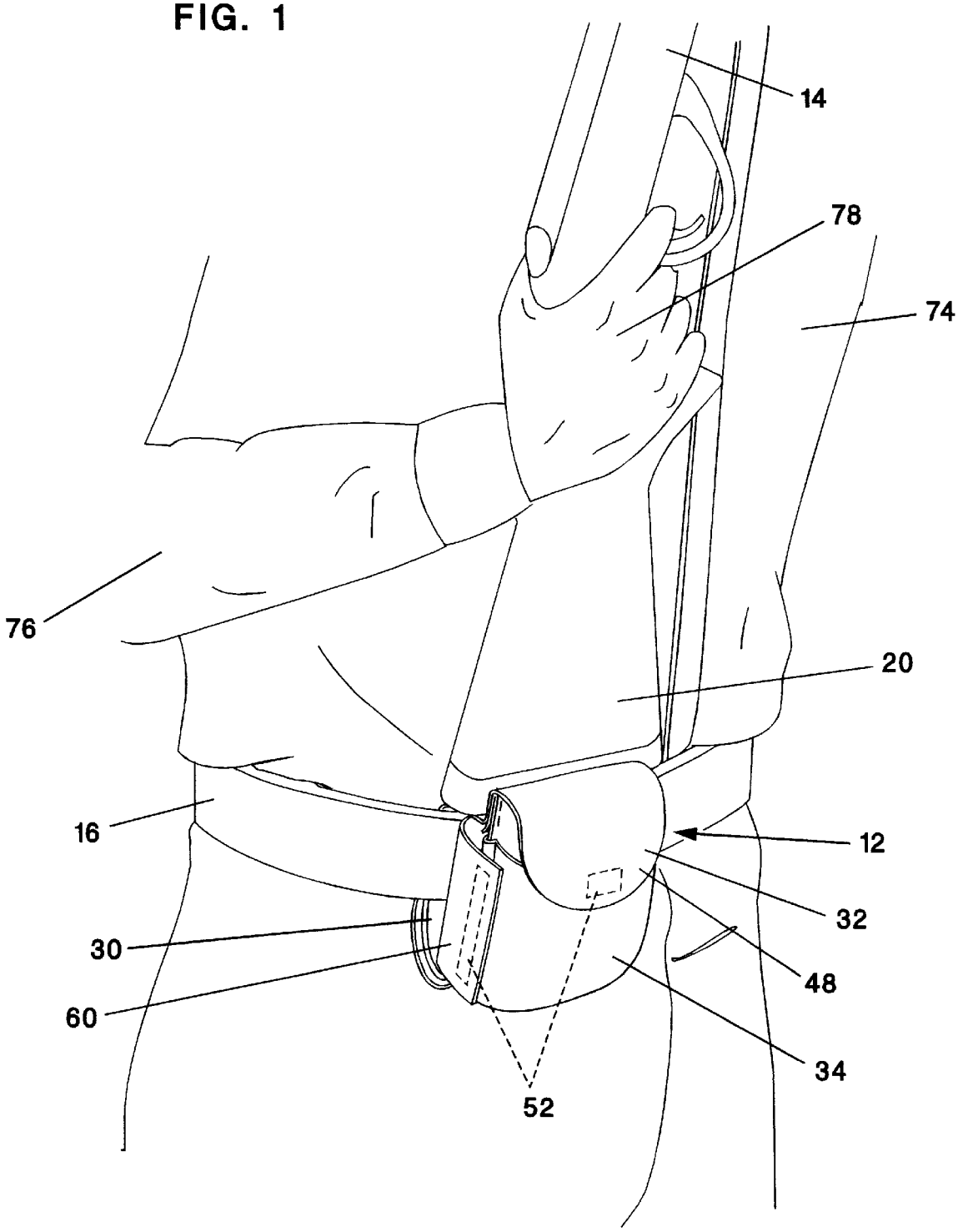
FIG. 1 is a perspective view of the firearm retaining apparatus of this invention as mounted on a user's belt member and shown with a hunting rifle mounted thereon in a vertical position and grasped by a hand member of the user.

The following is a discussion and description of preferred specific embodiments of the firearm retaining apparatus of this invention, such being made with reference to the drawings, whereupon the same reference numerals are used to indicate the same or similar parts and/or structure. It is to be understood that such discussion and description is not to unduly limit the scope of the invention.

DETAILED DESCRIPTION OF THE INVENTION

On referring to the drawings in detail, and in particular to FIG. 1, a firearm retaining apparatus of this invention, indicated generally at 12, is shown as mounted on a user's belt member 16 and operable to vertically support a hunting rifle 14 thereon.

Figure 2:
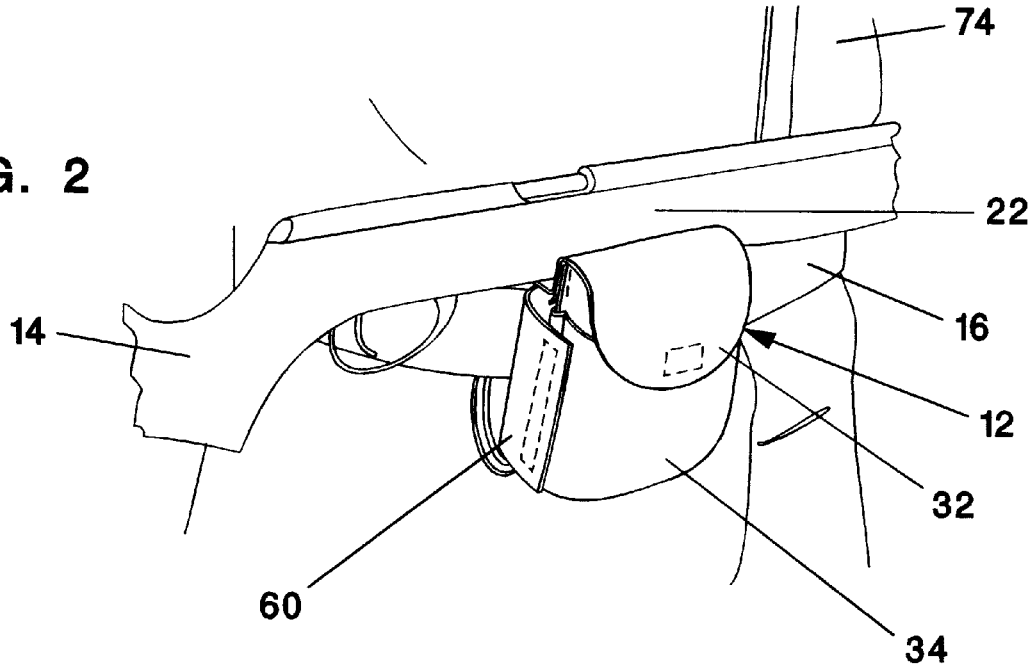
FIG. 2 is a perspective view similar to FIG. 1 illustrating the hunting rifle being supported at a mid portion thereof on the firearm retaining apparatus of this invention.

The hunting rifle 14 includes a shoulder section 20 which is mounted on the firearm retaining apparatus 12 and the hunting rifle 14 has a mid support section 22 which can be supported horizontally thereon as shown in FIG. 2. The hunting rifle 14 is operable to be utilized with rifle cartridge shells 18 having outer end sections 24 and supported within the firearm retaining apparatus 12 in a manner to be described.

The firearm retaining apparatus 12 includes 1) a main firearm retainer member 30; 2) a retainer and flap cover assembly 32; and 3) a front pocket and cartridge retainer assembly 34.

Figure 7:
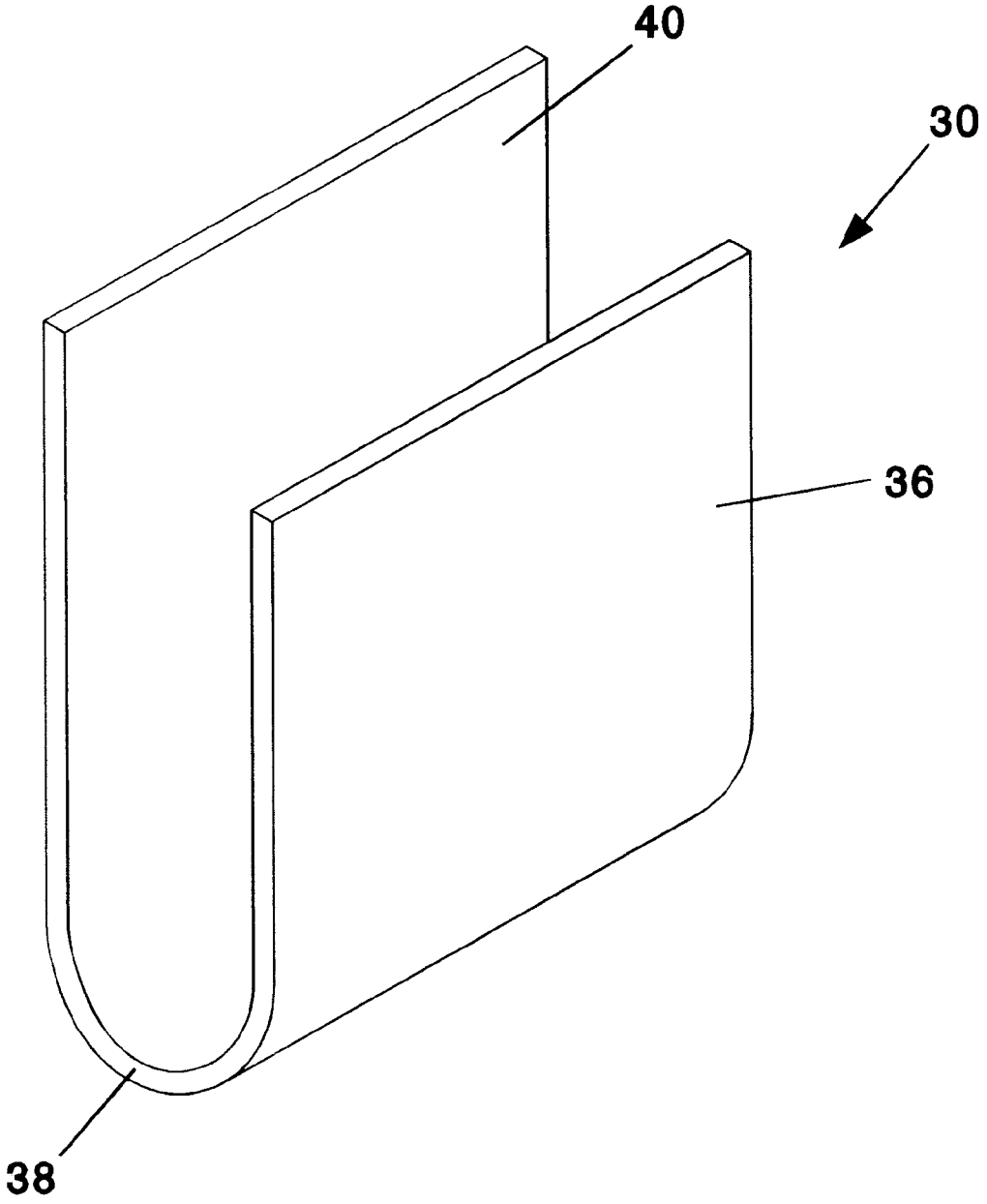
FIG. 7 is a perspective view of a main firearm retainer member utilized in the firearm retaining apparatus of this invention.

As shown in FIG. 7, the main firearm retainer member 30 is of a generally U-shape constructed of a rigid material such as plastic, aluminum, or steel, and having a rear wall section 36 which is integral with an intermediate wall section 38 which, in turn, is integral with a front wall section 40.

Figure 5:
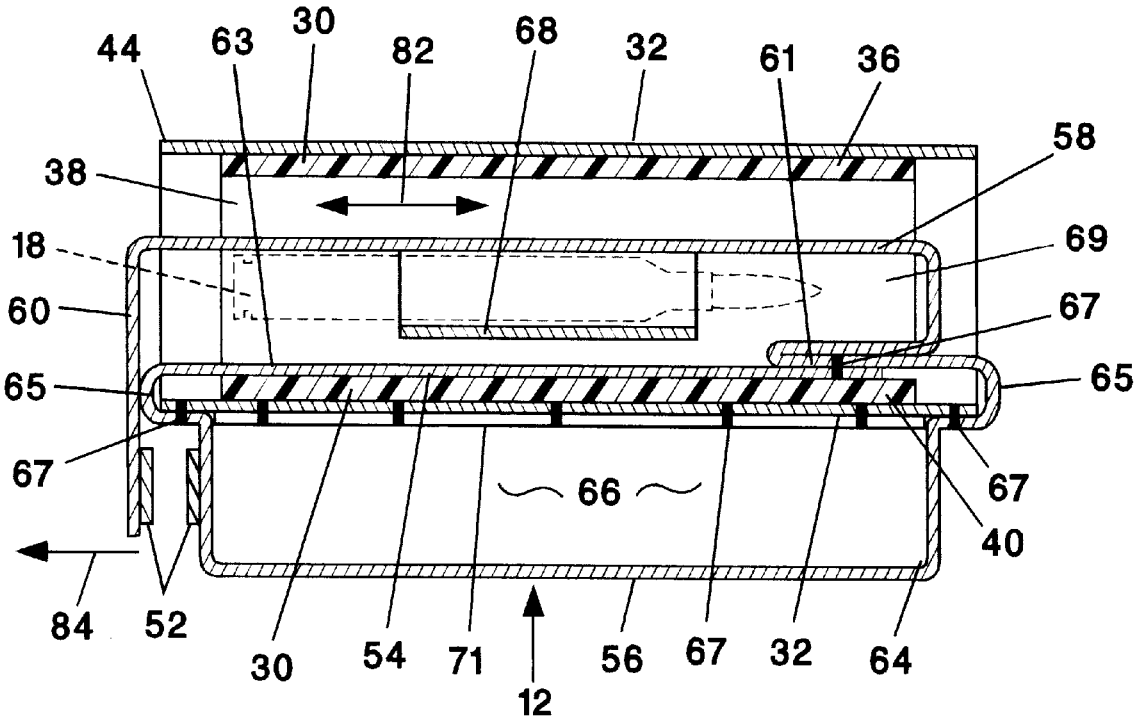
FIG. 5 is a sectional view taken along line 5—5 in FIG. 4.
Figure 6:
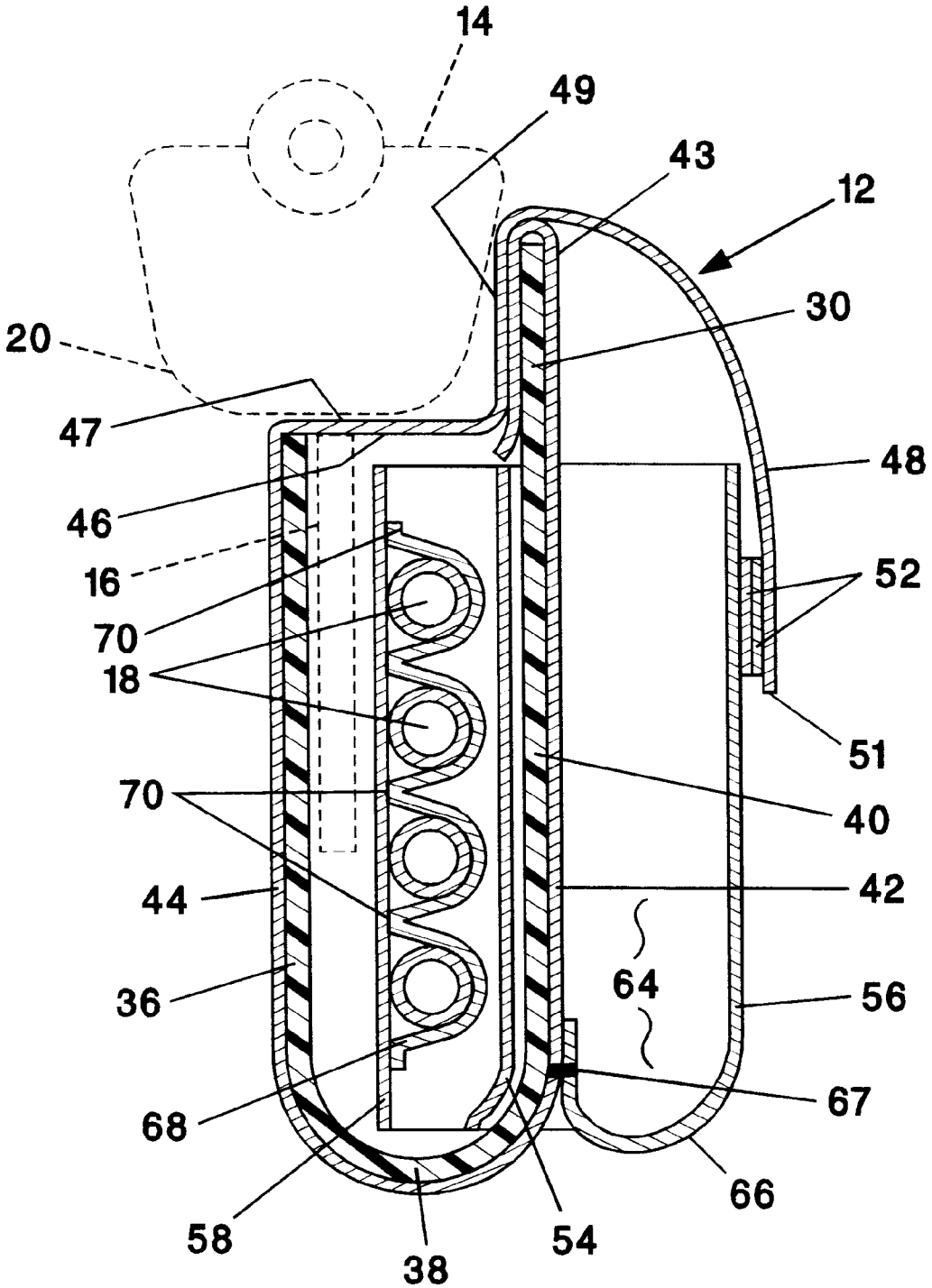
FIG. 6 is a sectional view taken along line 6—6 in FIG. 4 with a hunting rifle mounted thereon.

The main firearm retainer member 30 is to be surrounded and enclosed by portions of nylon or leather material as will be explained and as shown in FIGS. 5 and 6.

Figure 9:
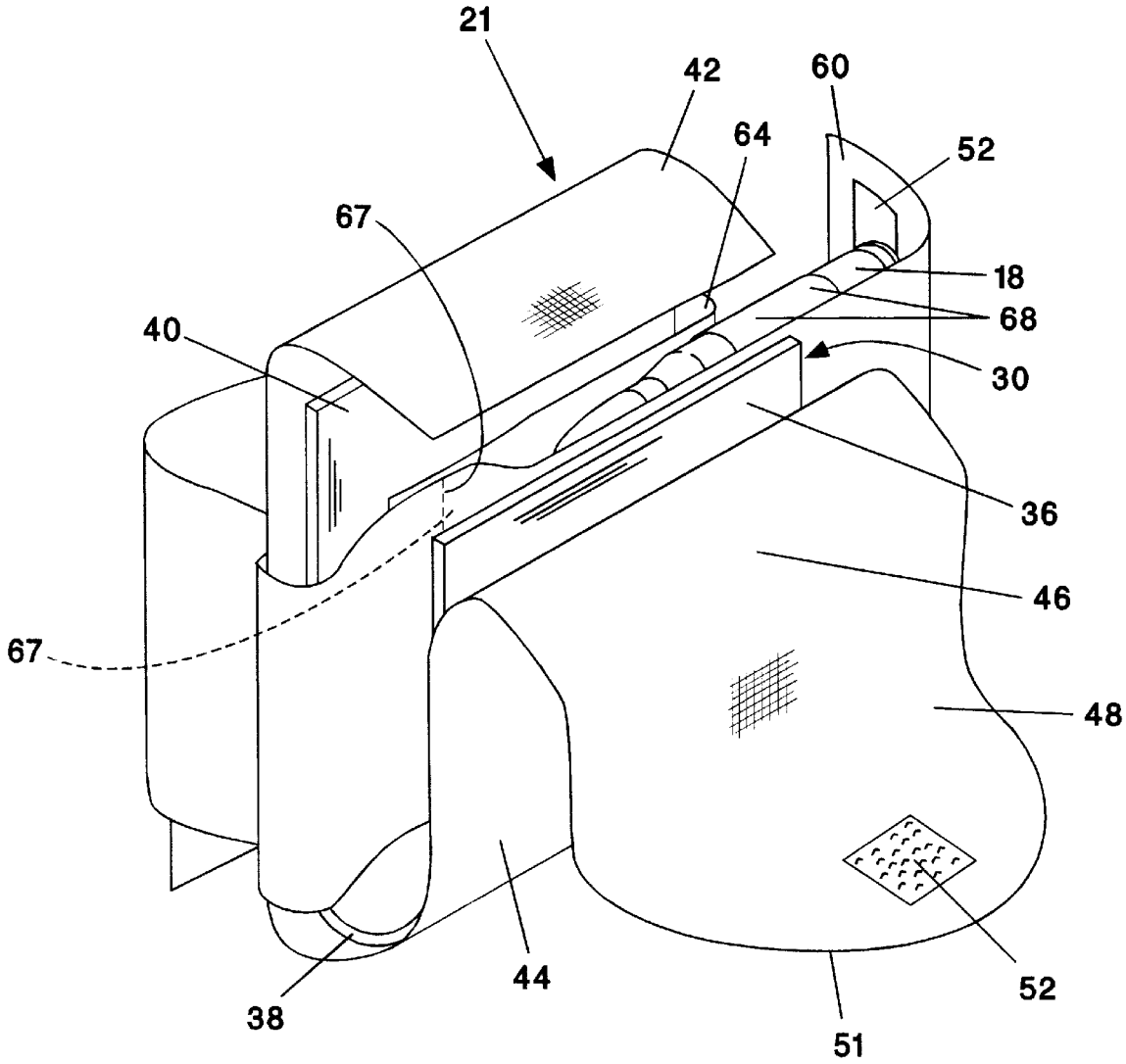
FIG. 9 is a perspective view of the firearm retaining apparatus of this invention before being interconnected by a stitching operation.

As shown in FIG. 9, the retainer and flap cover assembly 32, preferably constructed of a flexible, slip resistant material, includes a front wall retainer cover section 42 integral with a rear wall retainer cover section 44 which is integral with a belt contacting section or gun retaining section 46 which, in turn, is integral with a front pocket cover section 48.

Figure 4:
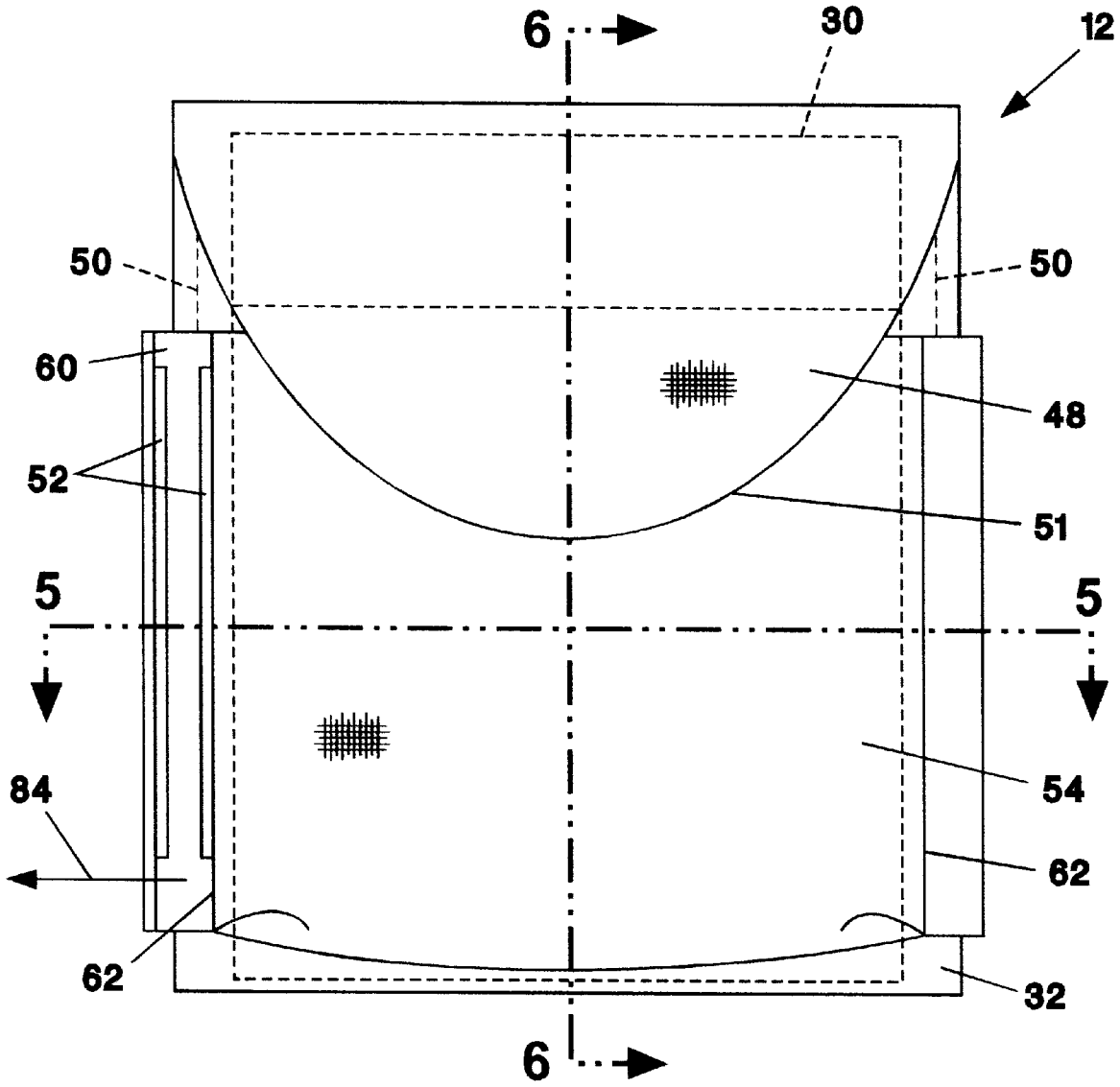
FIG. 4 is a front elevational view of the firearm retaining apparatus of this invention.

The front wall retainer cover section 42 is provided with outer folded end portions 43 to be interconnected to itself by a stitch portion 50. (FIG. 4).

On referring to the cross sectional view of FIG. 6, it is readily observed that the retainer and flap cover assembly 32 first has the front wall retainer cover section 42 mounted about the front wall section 40 of the main firearm retainer member 30 and is trained downwardly and about an outer surface of the main firearm retainer member 30 forming the rear wall retainer cover section 44.

The front wall cover section 48 is provided with outer anchor sewed portions 50 and having an outer curved edge 51 and a hook and loop connector 52 thereon.

From this point, the retainer and flap cover assembly 32 extends through the belt contacting section 46 and integral with the front wall cover section 48 which is shown as releasably attachable by the hook and loop connector 52 to a portion of the front pocket and cartridge retainer assembly 34.

The hook and loop connectors to be utilized herein are of a known construction having a hook section engageable with a loop section in a well-known manner to provide a sturdy but readily releasable anchor assembly.

As shown in FIG. 5, the front pocket and cartridge retainer assembly 34 is of a one-piece construction having a front retainer cover section 54 integral with a front pocket section 56 which, in turn, is integral with a cartridge retainer storage section 58 which is integral with an outer cartridge retainer section 60. The front pocket cartridge retainer assembly 34 can be constructed of a leather or nylon flexible material.

The front retainer cover section 54 includes an anchor portion 61 integral with a front wall portion 63. The anchor portion 61 is secured by a stitch portion 67 to a portion of the cartridge retainer storage section 58 as will be explained.

The front pocket section 56 is provided with outer end wall portions 65, a bottom wall portion 66, and a hook and loop connector 52 thereon. Stitch portions 67 interconnect end wall portions 65 to themselves and adjacent portions of the front wall retainer cover section 42 of the retainer and flap cover assembly 32.

The bottom wall portion 66 has an outer end portion 71 folded upwardly and secured as by a stitch portion 67 to an adjacent portion of the front wall retainer cover section 42.

One of the end wall portions 65 is wrapped around an outer edge portion of the main firearm retainer member 30 and then integral with the cartridge retainer storage section 58 which then extends until integral with the outer cartridge retainer section 60.

Figure 8:
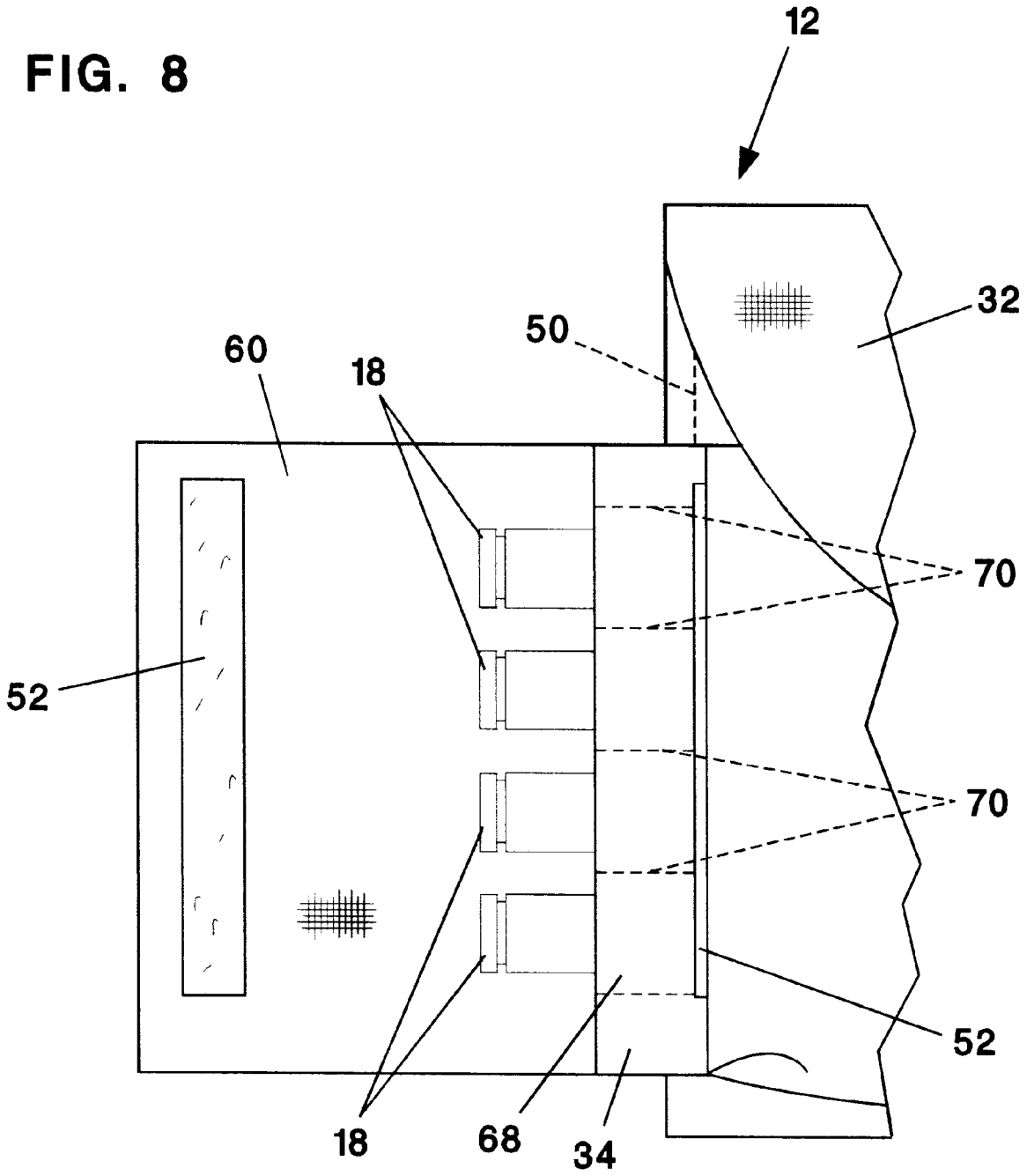
FIG. 8 is a fragmentary front elevational view similar to FIG. 4 having an outer cartridge retainer section in the opened condition and moved outwardly to reveal rifle cartridges mounted therein.

The cartridge retainer storage section 58 is provided with a first loop portion 69 and a cartridge retainer member 68 of an elastic material which is sewn therein by a retainer stitch portion 70 as noted in FIG. 8. The elastic cartridge retainer member 68 is stitched into loops as clearly shown in FIG. 6 to receive respective ones of the rifle cartridge 18 so as to be held in a clamped manner.

The outer cartridge section 60 is provided with a hook and loop connector 52 which is selectively engageable with the hook and loop connector 52 on the first pocket section 56.

USE AND OPERATION OF THE INVENTION

In the use and operation of the firearm retaining apparatus 12 of this invention, the firearm retaining apparatus 12 can be readily and releasably connected to the user's belt member 16 and usually supported on a front mid section of a firearm user 74 as noted in FIG. 1. The belt member 16 is trained through an area indicated by an arrow 82 in FIG. 5.

Figure 3:
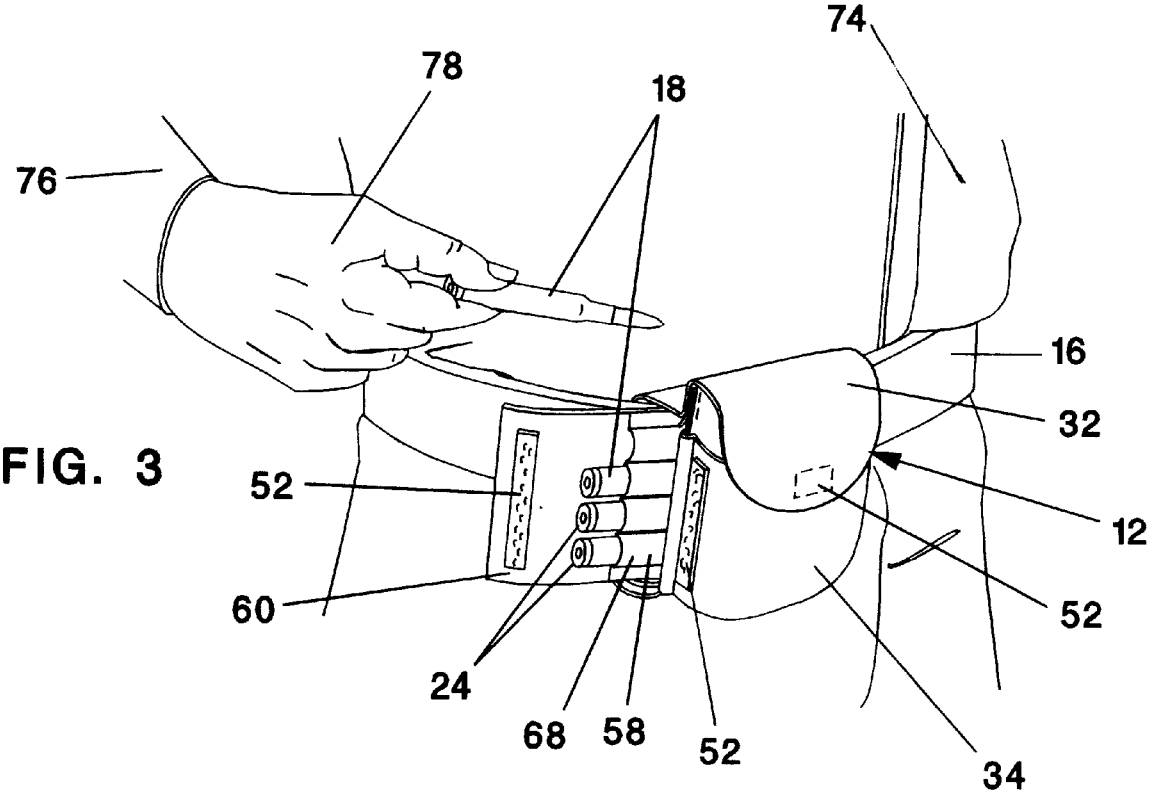
FIG. 3 is a view similar to FIG. 1 with the hunting rifle removed and illustrating the firearm retaining apparatus having a cartridge retainer section shown in an opened condition to reveal cartridge members and having the user's hand member holding a rifle cartridge for subsequent use thereof with the hunting rifle.

The firearm user 74 has an arm member 76 with a hand member 78 to grasp a rifle cartridge 18 as shown in FIG. 3 or the hunting rifle 14 as shown in FIG. 1.

The firearm user 74 has the firearm retaining apparatus 12 attached to the user's belt member 16 and having a plurality, namely four, rifle cartridges 18 mounted therein as shown in FIG. 6.

The hunting rifle 14 may be mounted with its shoulder section 20 mounted on the belt contacting section 46 of the firearm retaining apparatus 12 as noted in FIG. 1. This provides considerable rest and relief to the firearm user 74 as the weight of the user's rifle 14 is carried on the belt contacting section 46 and transferred through the user's belt member 16 to a waist portion of the user 74 to lessen stress loads received therefrom.

As noted in FIGS. 2 and 6, it is noted that the hunting rifle 14 can be placed in a generally horizontal position having a mid retaining section 22 mounted on the belt contacting section 46 to place the weight thereof through the user's belt member 16 to a waist portion of the firearm user 74 to relieve the strain of continuously supporting and carrying the hunting rifle 14.

As noted in FIG. 3, the firearm user 74 can readily open the outer cartridge retainer section 60 by moving laterally therefrom as noted by an arrow 84 to detach the hook and loop connectors 52 on the front pocket section 56 and the outer cartridge retainer section of the front pocket and cartridge retainer assembly 34.

At this time, the firearm user 74 can utilize its' finger members on the hand member 78 to grasp and remove a rifle cartridge 18 from elastic constraints of the cartridge retainer member 58 as noted in FIG. 3.

Next, the firearm user 74 would move the opened outer cartridge retainer section 60 to the closed condition as noted in FIGS. 1 and 2.

The firearm user 74 can then inject the removed rifle cartridge 18 into a loading area of the hunting rifle 14 to prepare the same for a firing operation.

It is noted that the firearm retaining apparatus 12 is a relatively simple construction requiring only four pieces thereof, namely, 1) the main firearm retainer member 30; 2) the one-piece retainer and flap cover assembly 32 of a flexible material; 3) the front pocket and cartridge and retainer assembly 34 of a one-piece construction extended horizontally about the main firearm retainer member 30; and 4) the cartridge retainer member 68 of an elastic material which is sewn to a portion of the front pocket and cartridge retainer assembly 34 and adapted to receive and support the rifle shells or cartridges 18 thereon.

The retainer and flap cover assembly 32 is constructed of a leather material which increases its' durability, is attractive in appearance, and provides a rough leather outer surface to both receive and retain portions of the hunting rifle or shotgun 14 thereagainst. This is especially important in holding the mid support section 22 of the hunting rifle 14 as noted in FIG. 2 to restrict its lateral movement thereof during frictional contact therebetween. This frees up the hand members 78 of the firearm user 74 for other uses and functions.

As noted in FIG. 6, the belt contacting section or gun retaining section 46 is of an L-shape having a horizontal contacting portion or gun vertical support section 47 integral with a vertical anchor or lateral restraining portion 49.

The main firearm retainer member 30 is of U-shape with the rear or first wall section 36 being parallel and shorter in length to the front or second wall section 40. An outer portion of the second wall section 40 is enclosed by the vertical anchor portion 49 of the gun support section 46.

A belt receiving slot is shown by arrow 82 in FIG. 5 and is the area between an inner surface of the rear wall section 36 and an outer surface of the cartridge retainer storage section 58 as shown in FIG. 6.

The front pocket section 56 is operable to carry hunting or firearm supplies and the front pocket cover section 48 is disconnected from the front pocket section 56 and its hook and loop connector 52 to reveal an upper entrance opening through which articles are added and removed therefrom.

The firearm retaining apparatus is economical to manufacture; simple to use; sturdy in construction; and substantially maintenance free.

While the invention has been described in conjunction with preferred specific embodiments thereof, it will be understood that this description is intended to illustrate and not to limit the scope of the invention, which is defined by the following claims:

I claim:

1. A firearm retaining apparatus operable to retain a firearm and convey associated supplies, comprising:

a) a main firearm retainer member constructed of a rigid material; and b) a retainer and flap cover assembly mounted about said main firearm retainer member and secured to itself to form 1) a first area to receive a user's belt member therein for vertical and lateral support; and 2) a stepped area above said first area to receive user's belt member to position a portion of a firearm between a user's body and a portion of said main firearm retainer member to restrict lateral movement of the firearm.

2. A firearm retaining apparatus as described in claim 1, wherein:

a) said main firearm retainer member having a pair of parallel wall sections having one of a greater length than the other; and b) said wall portion of the greater length adapted to be extended upwardly to form said stepped area being of L-shape between the user's body to restrict lateral movement of the firearm.

3. A firearm retaining apparatus operable to retain a firearm and convey associated supplies, comprising:

a) a main firearm retainer member constructed of a rigid material and of a U-shape; and b) a retainer and flap cover assembly mounted about said main firearm retainer member and secured to itself to form 1) a first area to receive a user's belt member therein for vertical and lateral support; and 2) a stepped area to position a portion of a firearm between a user's body and a portion of said main firearm retainer member to restrict lateral movement of the firearm;

c) a front pocket and cartridge retainer assembly extended about and enclosing a portion of said main firearm retainer member and forming therewith 1) an outer front pocket section adapted to hold articles therein; and 2) a cartridge retainer storage section to receive and support a plurality of cartridges therein and being held in an enclosed manner within confines of said main firearm retainer member.

4. A firearm retaining apparatus as described in claim 3, wherein:

a) said front pocket section having means thereon for interconnection with a portion of said retainer and flap cover assembly so as to provide a closure flap member over said front pocket section to hold articles therein.

5. A firearm retaining apparatus as described in claim 3, wherein:

a) said cartridge retainer storage section having a cartridge retainer member therein provided with a plurality of loops adapted to hold individual cartridges therein; and b) said front pocket and cartridge retainer assembly includes a cartridge retainer section connected to an outer cartridge retainer section and operable to be engaged with a connecting means on said front pocket section to hold said cartridge retainer storage section in an enclosed clamped relationship.

6. A firearm retaining apparatus as described in claim 5, wherein:

a) said cartridge retainer storage section includes a cartridge retainer member constructed of an elastic material and formed with individual loops to receive and retain respective cartridges therein.

7. A firearm retaining apparatus, comprising:

a) a main firearm retainer member of U-shape having spaced parallel leg wall sections with one of said leg wall sections longer than the other;

b) a retainer and flap cover assembly mounted about said main firearm retainer member and secured to itself adjacent an outer end of the longer one of said leg wall sections; and c) said retainer and flap cover assembly forms an L-shaped belt contacting section between an outer end of a shorter one of said leg wall section and said outer end of the longer one of said leg wall section;

whereby a firearm is operable to rest in said belt contacting section and held against lateral movement by contact with a user's body and the longer one of said leg wall sections.

8. A firearm retaining apparatus as described in claim 7, wherein:

a) said retainer and flap cover assembly constructed of a flexible material to provide a resistance to lateral movement of a firearm in contact therewith.

9. A firearm retaining apparatus as described in claim 7, including:

a) a front pocket and cartridge retainer assembly mounted about the longer one of said leg wall sections and forming therewith 1) a front pocket section adapted to receive and support articles therein; and 2) a cartridge retainer storage section mounted between said leg wall sections and having therein a cartridge retainer member with loops therein to receive and support respective ones of cartridge members and having an outer cartridge retainer section secured by connector means to said front pocket section to hold and enclose the cartridges therein.

10. A firearm retaining apparatus as described in claim 9, wherein:

a) said front pocket section having a connector means thereon which is engageable with an outer front pocket cover section of said retainer and flap cover assembly so as to be releasably and selectively enclose and reveal an entrance opening into said front pocket section.

11. A firearm retaining apparatus as described in claim 7; wherein:

a) a belt receiving slot is formed between said leg wall sections of said main firearm retainer member and operable to receive a user's belt member therein to provide vertical support to a firearm mounted thereon.

12. A firearm retaining apparatus as described in claim 9, wherein:

a) said cartridge retainer storage section having a loop portion adjacent a sewed connection to itself allowing said cartridge retainer member to move laterally with lateral movement of said outer cartridge retainer section to provide ready access to the cartridges held in said loops in said cartridge retainer member.

13. A firearm retaining apparatus adapted to retain a firearm, firearm cartridges, and other items used in conjunction with a firearm, comprising:

a) a main firearm retainer member of U-shape having a first wall section connected by an intermediate wall section to a second wall section; and b) a retainer cover assembly mounted about said main firearm retainer member forming 1) a belt receiving slot; and 2) a gun retaining section positioned above said belt receiving slot between said first wall section and said second wall section to hold a portion of a firearm between a user's body and a portion of said main firearm retainer member to restrict lateral movement of the firearm.

14. A firearm retaining apparatus as described in claim 13, wherein:

a) said second wall section is of a greater length than said first wall section and extended laterally outwardly therefrom; and b) said gun retaining section being of L-shape having the longer wall section of said second wall section operable to receive a portion of the firearm thereagainst between the user's body and said second wall section to restrict lateral movement of the firearm from said gun retaining section.

15. A firearm retaining apparatus adapted to retain a firearm, firearm cartridges, and other items used in conjunction with a firearm, comprising:

a) a main firearm retainer member of U-shape having a first wall section connected by an intermediate wall section to a second wall section; and b) a retainer cover assembly mounted about said main firearm retainer member forming 1) a belt receiving slot; and 2) a gun retaining section between said first wall section and said second wall section; and c) a front pocket and cartridge retainer assembly mounted about said second wall section and secured to said retainer cover assembly and forming 1) a front pocket section to hold articles therein; and 2) a cartridge retainer storage section mounted between said first wall section and said second wall section and having a cartridge retainer member to receive and independently support a cartridge member therein.

16. A firearm retaining apparatus as described in claim 15, wherein:

a) said retainer cover assembly having a front pocket cover section having anchor means thereon and releasably connected to an anchor means on said front pocket section to enclose same and releasably opened to remove or insert article members therein.

17. A firearm retaining apparatus as described in claim 15, wherein:

a) said cartridge retainer storage section having a first loop portion and an outer cartridge retainer section;

b) said loop portion allows for said outer cartridge retainer section and said cartridge retainer storage section to be movable outwardly to reveal outer ends of cartridges held therein for easy removal and insertion thereof; and c) said outer cartridge retainer section having a connector means thereon engageable with said front pocket section so as to interconnect said cartridge retainer storage section thereto and prevent unintentional lateral movement thereof while securely enclosing the cartridges therein.

18. A firearm retaining apparatus as described in claim 15, wherein:

a) said cartridge retainer member of an elastic material and forming a plurality of loops; and each of said loops to receive and hold a respective cartridge therein.

* * * * *